US010440460B2

(12) United States Patent
McCarthy et al.

(10) Patent No.: US 10,440,460 B2
(45) Date of Patent: Oct. 8, 2019

(54) WIRELESS IN-EAR HEADPHONES

(71) Applicant: T.REX Holdings, LLC, Edina, MN (US)

(72) Inventors: Michael James McCarthy, Edina, MN (US); Carl Francis Masters, Lawrence, KS (US); Matthew R. McCarthy, Edina, MN (US)

(73) Assignee: T.Rex Holdings, LLC, Edina, MN (US)

( * ) Notice: Subject to any disclaimer, the term of this patent is extended or adjusted under 35 U.S.C. 154(b) by 0 days.

(21) Appl. No.: 15/950,447

(22) Filed: Apr. 11, 2018

(65) Prior Publication Data

US 2018/0234755 A1 Aug. 16, 2018

Related U.S. Application Data

(63) Continuation of application No. 15/369,448, filed on Dec. 5, 2016, now Pat. No. 9,949,009, which is a (Continued)

(51) Int. Cl.
*H04R 1/10* (2006.01)
*H04R 3/12* (2006.01)

(52) U.S. Cl.
CPC ..... *H04R 1/1016* (2013.01); *H04R 1/105* (2013.01); *H04R 1/1025* (2013.01); (Continued)

(58) Field of Classification Search
CPC .. H04R 1/1016; H04R 1/1025; H04R 1/1041; H04R 1/105; H04R 1/1058; (Continued)

(56) References Cited

U.S. PATENT DOCUMENTS 1,824,427 A 9/1931 Fensky
2,521,162 A 9/1950 Harris
(Continued)

FOREIGN PATENT DOCUMENTS

WO 2016007375 A1 1/2016

OTHER PUBLICATIONS

International Preliminary Report on Patentability issued in PCT/US2015/039022, dated Jan. 10, 2017, 9 pages.
(Continued)

*Primary Examiner* — Thang V Tran

(57) ABSTRACT

A headphone system including a first earpiece, a second earpiece, and a coupler. The headphone system receives a wireless signal having audio content from an external audio source and reproduces at least a portion of the audio content using the first and second earpieces. The first earpiece includes a power source connector to be removably connected to an external power source, a first energy storage device coupled to receive power from the power source connector, and a first power transfer device coupled to receive power from the power source connector. The second earpiece includes a second power transfer device for receiving power from the first power transfer device and a second energy storage device coupled to receive power from the second power transfer device. The coupler is to hold the first and second earpieces together with the first and second power transfer devices in a power transfer configuration.

11 Claims, 6 Drawing Sheets

Related U.S. Application Data continuation of application No. 14/328,369, filed on Jul. 10, 2014, now Pat. No. 9,516,401.

(52) U.S. Cl.
CPC ..... *H04R 1/1058* (2013.01); *H04R 1/1091* (2013.01); *H04R 3/12* (2013.01); *H04R 2420/07* (2013.01)

(58) Field of Classification Search
CPC ..... H04R 1/1066; H04R 1/1091; H04R 2420/07; H04R 2420/09; H04R 5/033; H04R 3/00; H04R 3/12; H04R 25/554; H04R 2225/55; H04R 2201/10; H04W 4/80

See application file for complete search history.

(56) References Cited

U.S. PATENT DOCUMENTS

| | | | |
|---|---|---|---|
| 2,625,612 | A | 1/1953 | Klein et al. |
| D179,150 | S | 11/1956 | Norris |
| D180,695 | S | 7/1957 | Norris |
| 3,034,320 | A | 5/1962 | Feibelman |
| 5,036,681 | A | 8/1991 | Schaerer |
| 5,561,275 | A | 10/1996 | Savage et al. |
| 5,796,821 | A | 8/1998 | Crouch et al. |
| D447,743 | S | 9/2001 | Ma |
| D469,422 | S | 1/2003 | Nguyen et al. |
| D470,129 | S | 2/2003 | Hlas et al. |
| 6,598,272 | B2 | 7/2003 | Nire |
| D498,227 | S | 11/2004 | Dyer et al. |
| D504,672 | S | 5/2005 | Hirano |
| D504,673 | S | 5/2005 | Dyer et al. |
| D510,575 | S | 10/2005 | Leong |
| D512,984 | S | 12/2005 | Ham |
| D514,551 | S | 2/2006 | Lee et al. |
| D515,069 | S | 2/2006 | Naito |
| D541,787 | S | 5/2007 | Ma |
| D557,255 | S | 12/2007 | Shintani et al. |
| 7,311,526 | B2 | 12/2007 | Rohrbach et al. |
| D571,784 | S | 6/2008 | Jensen et al. |
| D572,234 | S | 7/2008 | Reda et al. |
| D585,429 | S | 1/2009 | Dean |
| D602,004 | S | 10/2009 | Matsuoka |
| D603,847 | S | 11/2009 | Chung |
| D617,778 | S | 6/2010 | Birger |
| 7,747,003 | B2 | 6/2010 | Regen et al. |
| D625,297 | S | 10/2010 | Tseng et al. |
| D629,397 | S | 12/2010 | Hensen |
| D635,559 | S | 4/2011 | Rye et al. |
| D635,960 | S | 4/2011 | Gondo et al. |
| D636,762 | S | 4/2011 | Hensen |
| D641,009 | S | 7/2011 | Olodort et al. |
| 8,180,078 | B2 | 5/2012 | Zellner |
| 8,265,328 | B2 | 9/2012 | Milde et al. |
| 8,467,562 | B2 | 6/2013 | Wada |
| D685,768 | S | 7/2013 | Mogili |
| D695,275 | S | 12/2013 | Chee |
| D698,760 | S | 2/2014 | Lee et al. |
| 8,655,005 | B2 | 2/2014 | Birger et al. |
| D700,905 | S | 3/2014 | Pavitsich |
| 8,699,732 | B2 | 4/2014 | Zellner |
| D717,281 | S | 11/2014 | Zambelli |
| D718,283 | S | 11/2014 | Thompson et al. |
| 8,891,798 | B1 | 11/2014 | Laffon de Mazieres et al. |
| 9,516,401 | B2 | 12/2016 | McCarthy |
| 9,949,009 | B2 | 4/2018 | McCarthy |
| 2006/0008106 | A1 | 1/2006 | Harper |
| 2007/0049198 | A1 | 3/2007 | Walsh et al. |
| 2007/0053544 | A1 | 3/2007 | Jhao et al. |
| 2007/0147630 | A1 | 6/2007 | Chiloyan |
| 2008/0076489 | A1 | 3/2008 | Rosener et al. |
| 2008/0101633 | A1 | 5/2008 | Ledbetter et al. |
| 2008/0159579 | A1 | 7/2008 | Park |
| 2009/0046869 | A1 | 2/2009 | Griffin et al. |
| 2009/0180649 | A1 | 7/2009 | Hsu et al. |
| 2009/0285434 | A1 | 11/2009 | Williams et al. |
| 2010/0048138 | A1 | 2/2010 | Tomoda |
| 2011/0103609 | A1 | 5/2011 | Pelland et al. |
| 2011/0110552 | A1 | 5/2011 | Pang et al. |
| 2011/0216932 | A1 | 9/2011 | Wu |
| 2011/0286615 | A1 | 11/2011 | Olodort et al. |
| 2012/0027215 | A1 | 2/2012 | Sim et al. |
| 2012/0041581 | A1 | 2/2012 | Lee |
| 2012/0140976 | A1* | 6/2012 | Birger ..... H04M 1/05 381/381 |
| 2013/0058517 | A1 | 3/2013 | Lee et al. |
| 2013/0114203 | A1* | 5/2013 | Ignatchenko ..... G06F 1/1632 361/679.41 |
| 2013/0311176 | A1 | 11/2013 | Brian Brown et al. |
| 2014/0079238 | A1 | 3/2014 | Bastide et al. |
| 2014/0376735 | A1* | 12/2014 | Asrani ..... H04R 1/1041 381/74 |
| 2015/0195639 | A1 | 7/2015 | Azmi et al. |
| 2015/0245129 | A1 | 8/2015 | Dusan et al. |
| 2016/0014492 | A1 | 1/2016 | McCarthy et al. |
| 2017/0238080 | A1 | 8/2017 | McCarthy |

OTHER PUBLICATIONS

International Search Report and Written Opinion issued in PCT/US2015/039022, dated Oct. 16, 2015, 13 pages.

* cited by examiner

WIRELESS IN-EAR HEADPHONES

CROSS-REFERENCE TO RELATED APPLICATION

This application is a continuation of U.S. patent application Ser. No. 15/369,448, filed Dec. 5, 2016, now U.S. Pat. No. 9,949,009, granted Apr. 17, 2018, which is a continuation of U.S. patent application Ser. No. 14/328,369, filed Jul. 10, 2014, now U.S. Pat. No. 9,516,401, issued Dec. 6, 2016, both of which are incorporated herein by reference in their entireties for all purposes.

TECHNICAL FIELD

The present disclosure relates to headphones. More specifically, the present disclosure relates to wireless in-ear headphones.

BACKGROUND

Typically, headphones include audio drivers or speakers that are placed close to a user's head or in the user's ears for listening to audio content. In-ear versions of the headphones are also referred to as earbuds or earphones. Some headphones include wires that are plugged into an audio source to receive audio signals that drive the audio drivers in the headphones. Often, the wired headphones do not include any active circuits or power supplies. Some headphones include wireless connections for receiving wireless signals that include audio content. The wireless headphones receive and process the wireless signals to provide audio signals that drive the audio drivers in the headphones. The wireless headphones include active circuits and at least one power supply for processing the wireless signals and reproducing the audio content through the audio drivers.

SUMMARY

In one example of a headphone system, the headphone system includes a first earpiece, a second earpiece, and a coupler. The first earpiece includes a power source connector to be removably connected to an external power source, a first energy storage device coupled to receive power from the power source connector, and a first power transfer device coupled to receive power from the power source connector. The second earpiece includes a second power transfer device for receiving power from the first power transfer device and a second energy storage device coupled to receive power from the second power transfer device. The coupler is on one or both of the first and second earpieces to hold the first and second earpieces together with the first and second power transfer devices in a power transfer configuration.

In another example of a headphone system, the headphone system includes a first earpiece and a second earpiece. The first earpiece includes a first receiver to receive a first wireless signal having audio content, a first processor coupled to receive the first wireless signal and provide a first audio signal having at least a portion of the audio content, a first audio driver coupled to receive the first audio signal, and a transmitter coupled to the first receiver to transmit a second wireless signal having at least a portion of the audio content. The second earpiece includes a second receiver to receive the second wireless signal, a second processor coupled to receive the second wireless signal and provide a second audio signal having at least a portion of the audio content, and a second audio driver coupled to receive the second audio signal.

In another example of a headphone system, the headphone system includes a first earpiece and a second earpiece. The first earpiece includes a power source connector to be removably connected to an external power source, a first energy storage device coupled to receive power from the power source connector, a first power transfer device coupled to receive power from the power source connector, a first receiver to receive a first wireless signal having audio content, a first processor coupled to receive the first wireless signal and provide a first audio signal having at least a portion of the audio content, a first audio driver coupled to receive the first audio signal, and a transmitter coupled to the first receiver to transmit a second wireless signal having at least a portion of the audio content. The second earpiece includes a second power transfer device for receiving power from the first power transfer device, a second energy storage device coupled to receive power from the second power transfer device, a second receiver to receive the second wireless signal, a second processor coupled to receive the second wireless signal and provide a second audio signal having at least a portion of the audio content, and a second audio driver coupled to receive the second audio signal.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Figure 1:
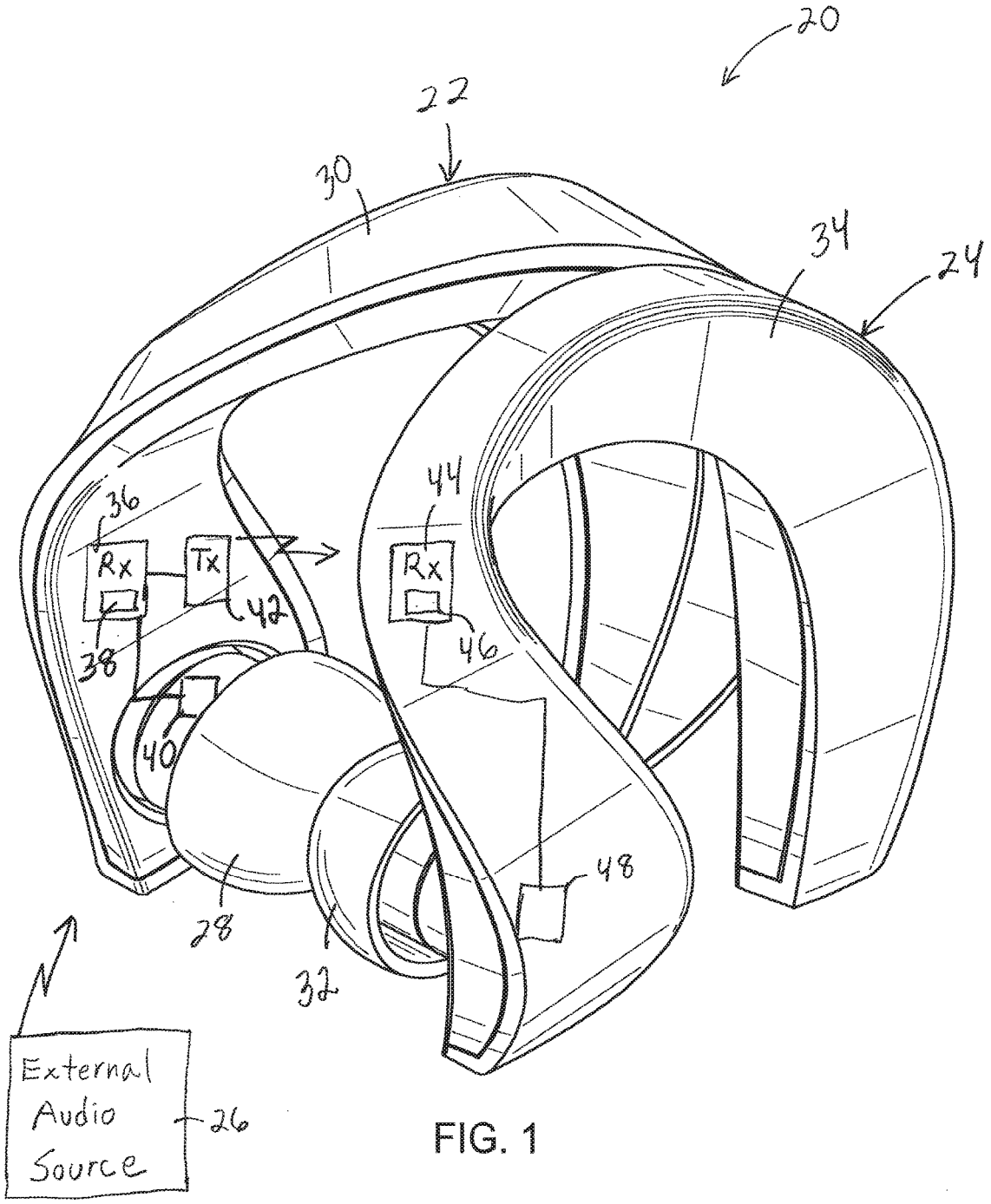
FIG. 1 is a diagram illustrating a perspective view of a headphone system in a joined charging configuration, according to some embodiments described in the disclosure.

FIGS. 1-5 are diagrams illustrating an in-ear headphone system 20 including a right earpiece 22 and a left earpiece 24, according to some embodiments described in the disclosure. The headphone system 20 receives a wireless, e.g., radio frequency (RF), signal having audio content from an external audio source 26. The headphone system 20 reproduces at least a portion of the audio content from the wireless signal using the right and left earpieces 22 and 24. The external audio source 26 can be a device, such as a computer, a mobile telephone, a radio, a television, a portable media player, an audio amplifier, a compact disc player, or a musical instrument. In some embodiments, the headphone system 20 uses radio frequency (RF) wireless signals. In some embodiments, the headphone system 20 uses Bluetooth technology and the wireless signal is a Bluetooth signal. In other embodiments, the headphone system 20 uses a wireless technology other than the Bluetooth technology.

The right and left earpieces 22 and 24 include first and second energy storage devices 64 and 66 (shown in FIG. 4), respectively, which are charged from an external power source 60 (shown in FIG. 4) connected to one of the right and left earpieces 22 and 24. The right and left earpieces 22 and 24 are held next to each other and configured to transfer power from the earpiece connected to the external power source 60 to the other earpiece of the right and left earpieces 22 and 24.

In regard to FIGS. 1-5, each of the right and left earpieces 22 and 24 includes certain components and performs certain functions of the headphone system 20. This is one example distribution of components and functions in the right and left earpieces 22 and 24, which is not intended to limit a component or a function to one side, i.e., to one of the right or left earpieces 22 and 24. Instead, in other examples, one or more of the components and functions described as being in the right earpiece 22 can be in the left earpiece 24 and/or one or more of the components and functions described as being in the left earpiece 24 can be in the right earpiece 22. For example, all of the components and functions of the right earpiece 22 can be in the left earpiece 24 and all of the components and functions of the left earpiece 24 can be in the right earpiece 22.

Figure 2:
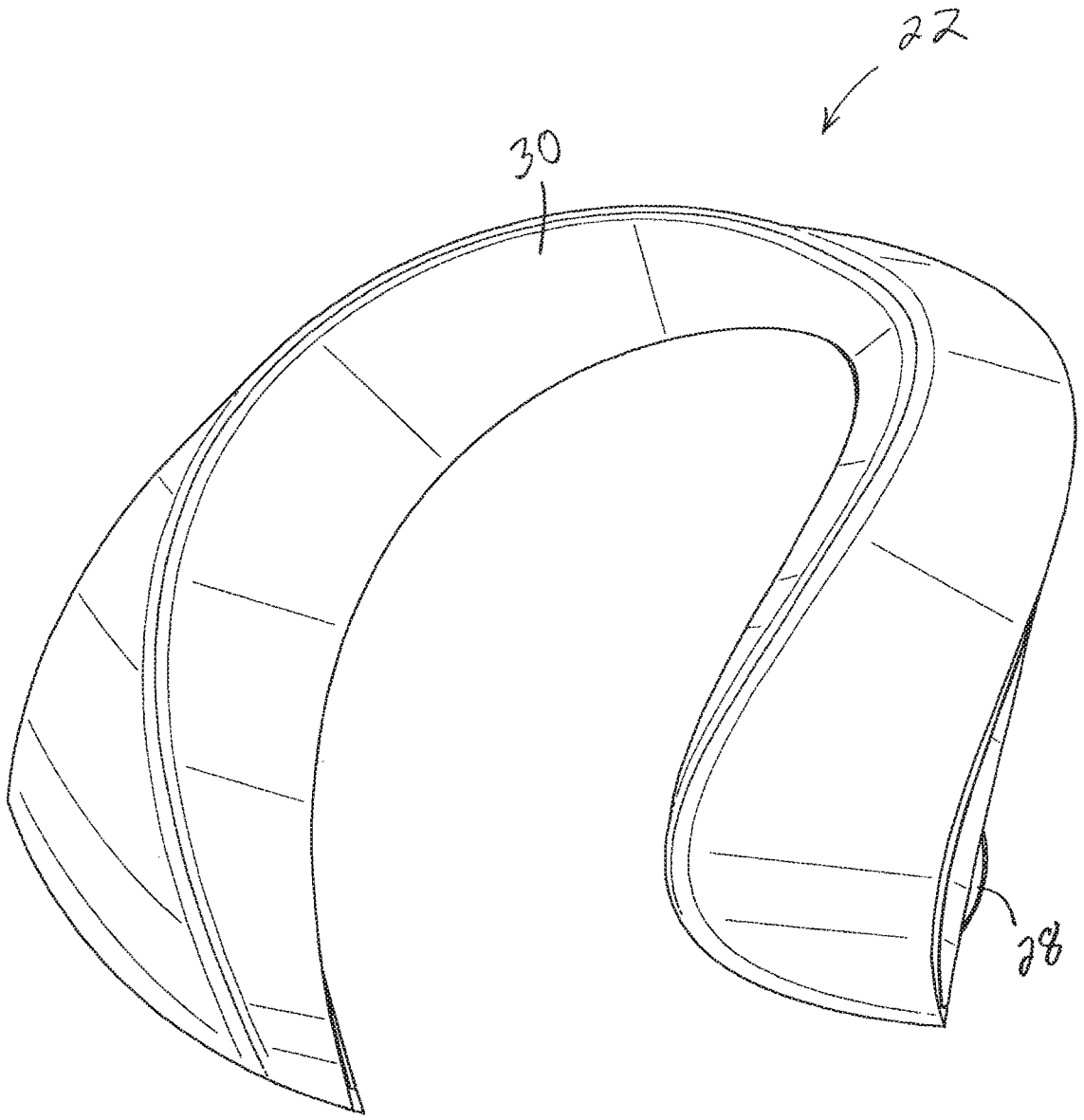
FIG. 2 is a diagram illustrating a side view of the right earpiece of the headphone system of FIG. 1, according to some embodiments described in the disclosure.
Figure 3:
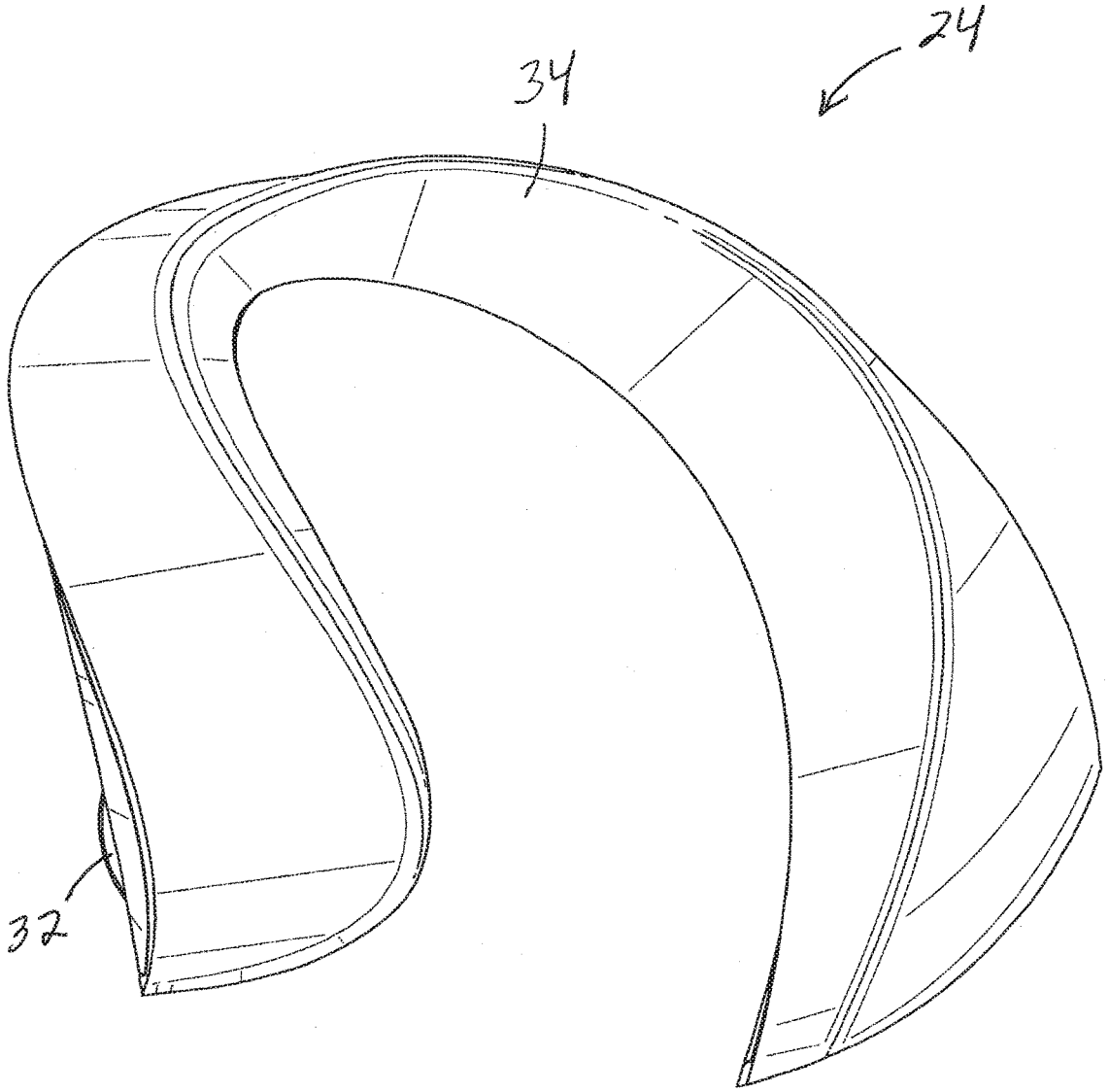
FIG. 3 is a diagram illustrating a side view of the left earpiece of the headphone system of FIG. 1, according to some embodiments described in the disclosure.

FIG. 1 is a diagram illustrating a perspective view of the headphone system 20 in a joined charging configuration, including the right and left earpieces 22 and 24 and at least some of the components for reproducing audio content, according to some embodiments. FIG. 2 is a diagram illustrating a side view of the right earpiece 22, according to some embodiments, and FIG. 3 is a diagram illustrating a side view of the left earpiece 24, according to some embodiments.

The right earpiece 22 includes a first ear tip or pad 28 that is inserted into the right ear canal of the user and a first contoured ear hook 30 that fits around the user's right ear to secure the first earpiece 22 to the user's head. The left earpiece 24 includes a second ear tip or pad 32 that is inserted into the left ear canal of the user and a second contoured ear hook 34 that fits around the user's left ear to secure the second earpiece 24 to the user's head. In some embodiments, the headphone system 20 provides monophonic sound through the right and left earpieces 22 and 24. In some embodiments, the headphone system 20 provides stereophonic sound through the right and left earpieces 22 and 24.

The right and left earpieces 22 and 24 utilize a master/slave relationship to reproduce the audio content from the wireless signal transmitted by the external audio source 26. One of the right and left earpieces 22 and 24 is the master and the other of the right and left earpieces 22 and 24 is the slave. In some embodiments described in this disclosure, the right earpiece 22 is the master and the left earpiece 24 is the slave. In other embodiments, the master/slave roles can be reversed, such that the left earpiece 24 is the master and the right earpiece 22 is the slave.

The right earpiece 22 includes a master device address, such as a first MAC address, that is shared with (transmitted to) the external audio source 26. The right earpiece 22 includes a first receiver 36 that receives the first wireless signal having audio content from the external audio source 26 and a first processor 38 coupled to the first receiver 36 to receive the first wireless signal and provide a first audio signal having at least a portion of the audio content from the first wireless signal. This first audio signal drives at least one audio driver 40 coupled to the first processor 38 in the first earpiece 22 to reproduce at least a portion of the audio content for the user. In addition, the right earpiece 22 includes a transmitter 42 coupled to the receiver 36 and the processor 40. The transmitter 42 transmits a second wireless signal having at least a portion of the audio content from the first wireless signal.

The left earpiece 24 includes a slave device address, such as a second MAC address, that is known by the right earpiece 22, but unknown and not shared with (hidden from) the external audio source 26. This communicatively links the right earpiece 22 to the left earpiece 24. The left earpiece 24 includes a second receiver 44 that receives the second wireless signal and a second processor 46 coupled to the second receiver 44 to receive the second wireless signal and provide a second audio signal having at least a portion of the audio content from the second wireless signal. This second audio signal drives at least one audio driver 48 coupled to the second processor 46 in the second earpiece 24 to reproduce at least a portion of the audio content from the second wireless signal for the user. In some embodiments, the first processor 38 introduces a synchronizing time delay in providing the first audio signal and/or the second wireless signal to synchronize the first audio signal with the second audio signal. In some embodiments, the second processor 46 introduces a synchronizing time delay in providing the second audio signal to synchronize the first audio signal with the second audio signal.

In operation, the external audio source 26 and the right earpiece 22 establish communications using the master device address. The external audio source 26 provides the first wireless signal having audio content, which is received by the first receiver 36 and processed by the first processor 38 to provide the first audio signal that drives the at least one audio driver 40 in the right earpiece 22. Also, the transmitter 42 transmits a second wireless signal having at least a portion of the audio content from the first wireless signal. The left earpiece 24, which is in communication with the right earpiece 22 using the slave device address, receives the second wireless signal via the second receiver 44 and the second processor 46 processes the second wireless signal to provide the second audio signal that drives the at least one driver 48 in the left earpiece 24. In some embodiments, at least one of the first and second wireless signals is an RF signal. In some embodiments, at least one of the first and second wireless signals is a Bluetooth signal.

In other embodiments, the master/slave roles are reversed, such that the left earpiece 24 is the master and includes the master device address, such as the first MAC address, that is shared with (transmitted to) the external audio source 26, and the right earpiece 22 is the slave that includes the slave device address, such as the second MAC address, that is known by the left earpiece 24, but unknown and not shared with (hidden from) the external audio source 26. In these embodiments, the left earpiece 24 includes a transmitter and, in at least some of these embodiments, the right earpiece 22 does not include a transmitter.

Figure 4:
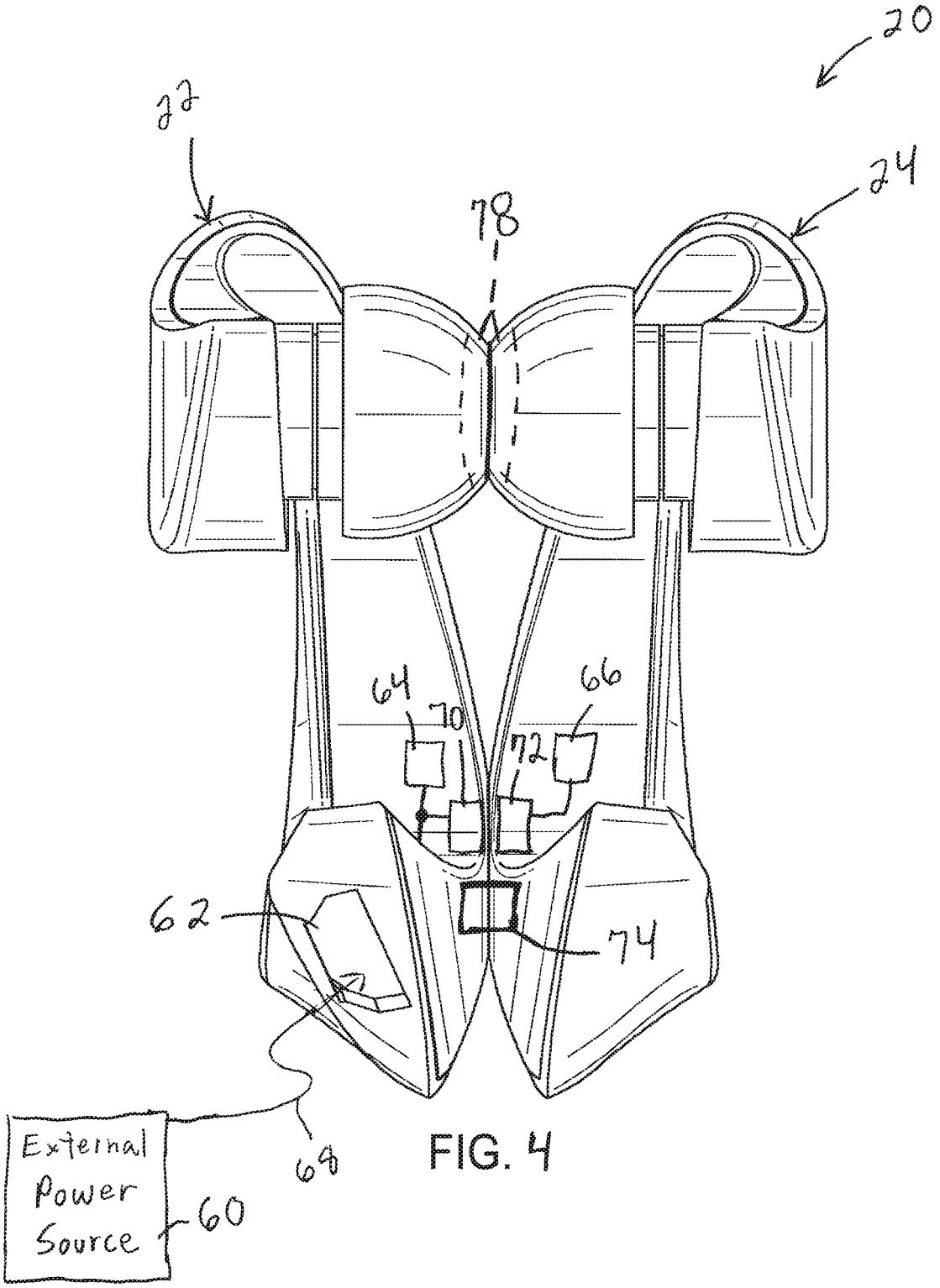
FIG. 4 is a diagram illustrating a bottom view of the headphone system of FIG. 1, according to some embodiments described in the disclosure.

FIG. 4 is a diagram illustrating a bottom view of the headphone system 20 of FIG. 1 and at least some of the components for charging the right and left earpieces 22 and 24, according to some embodiments described in the disclosure. In FIGS. 1 and 4, the right and left earpieces 22 and 24 are illustrated in the joined charging configuration, also referred to as a power transfer configuration, with the right and left earpieces 22 and 24 held together. In some embodiments, the right and left earpieces 22 and 24 are held together to touch each other in the power transfer configuration. In some embodiments, the right and left earpieces 22 and 24 are held together to be close enough to each other to transfer power in the power transfer configuration.

Each of the right and left earpieces 22 and 24 includes at least one active circuit and a power supply. The right and left earpieces 22 and 24 are charged by connecting one of the right and left earpieces 22 and 24 to an external power source, such as the external power source 60, and coupling it to the other one of the right and left earpieces 22 and 24. In some embodiments described in this disclosure, the right earpiece 22 includes a power source connector 62 that is removably connected to the external power source 60 to charge the first energy storage device 64 in the right earpiece 22, and the left earpiece 24 is coupled to the right earpiece 22 to charge the second energy storage device 66 in the left earpiece 24. In other embodiments, the roles of the right and left earpieces 22 and 24 are reversed, such that the left earpiece 24 includes the power source connector 62 that is removably connected to the external power source 60 to charge the second energy storage device 66 in the left earpiece 24 and the right earpiece 22 is coupled to the left earpiece 24 to charge the first energy storage device 64 in the right earpiece 22.

The power source connector 62 of the right earpiece 22 is electrically coupled to the external power source 60 via conductive path 68. The right earpiece 22 includes the first energy storage device 64 that is coupled to the power source connector 60 to receive power from the power source connector 60 and a first power transfer device 70 that is coupled to the power source connector 60 to receive power from the power source connector 60. In some embodiments, the power source connector 62 includes contacts that touch corresponding contacts connected to the external power source 60 to transfer power. In some embodiments, the power source connector 62 includes electrical contacts that are press fit together with corresponding electrical contacts connected to the external power source 60 to transfer power. In some embodiments, the power source connector 62 includes one or more inductive elements that interact with one or more inductive elements connected to the external power source 60 to accomplish inductive coupling and transfer power. In some embodiments, the power source connector 62 includes one or more capacitive elements that interact with one or more capacitive elements connected to the external power source 60 to accomplish capacitive coupling to transfer power.

The left earpiece 24 includes a second power transfer device 72 that is coupled to the first power transfer device 70 in the power transfer configuration to receive power from the first power transfer device 70. The second energy storage device 66 in the left earpiece 24 is coupled to the second power transfer device 72 to receive power from the second power transfer device 72. In other embodiments, the left earpiece 24 is electrically coupled to the external power source 60 and the right earpiece 22 receives power through the left earpiece 24, such that the components described above as being in the right earpiece 22 are in the left earpiece 24 and the components described above as being in the left earpiece 24 are in the right earpiece 22.

The first and second power transfer devices 70 and 72 transfer power between the right and left earpieces 22 and 24. In some embodiments, the first and second power transfer devices 70 and 72 include contacts that touch to transfer power between the right and left earpieces 22 and 24. In some embodiments, the first and second power transfer devices 70 and 72 include electrical contacts that are press fit together to transfer power between the right and left earpieces 22 and 24. In some embodiments, the first and second power transfer devices 70 and 72 include inductive elements that are held close enough together to accomplish inductive coupling to transfer power between the right and left earpieces 22 and 24. In some embodiments, the first and second power transfer devices 70 and 72 include capacitive elements that are held close enough together to accomplish capacitive coupling to transfer power between the right and left earpieces 22 and 24.

To transfer power, the first and second power transfer devices 70 and 72 are held next to each other in the power transfer configuration. In some embodiments, the first and second power transfer devices 70 and 72 are held next to each other to touch in the power transfer configuration. In some embodiments, the first and second power transfer devices 70 and 72 are held next to each other to be close enough to transfer power in the power transfer configuration.

In the power transfer configuration, the first and second power transfer devices 70 and 72 are held together by a coupler 74 that holds the right and left earpieces 22 and 24 together. The coupler 74 can be a single piece or structure on one of the right and left earpieces 22 and 24 that holds the right and left earpieces 22 and 24 together, such as a swing arm on one of the right and left earpieces 22 and 24 that wraps around the other one of the left and right earpieces 22 and 24, or the coupler 74 can include multiple portions or structures that hold the right and left earpieces 22 and 24 together, including one or more portions in the right earpiece 22 and one or more portions in the left earpiece 24. In some embodiments, portions of the coupler 74 are situated next to the first and second power transfer devices 70 and 72. In some embodiments, portions of the coupler 74 are part of the first and second power transfer devices 70 and 72, such as with electrical contacts that are press fit together. In some embodiments, portions of the coupler 74 are part of the first and second power transfer devices 70 and 72, such as with magnets in the first and second power transfer devices 70 and 72. In other embodiments, the coupler 74 or portions of the coupler 74 can be situated at any suitable position in the right and/or left earpieces 22 and 24.

In addition, another coupler 78 can include portions situated at or toward the ends of the first and second ear tips 28 and 32, such as ring style magnetic connectors at or near the ends of the first and second ear tips 28 and 32. In some embodiments, portions of the coupler 74 are situated next to or in the first and second power transfer devices 70 and 72 and portions of the coupler 78 are at or near the ends of the first and second ear tips 28 and 32.

In embodiments, in the power transfer configuration, the coupler 74 includes at least one magnet in one of the right and left earpieces 22 and 24 that aligns with at least one other magnet or at least one other piece of ferromagnetic material in the other one of the right and left earpieces 22 and 24. The coupler 74 provides magnetic coupling that holds the power transfer devices 70 and 72 together. In some embodiments, the coupler 74 includes multiple magnets in multiple locations in one of the right and left earpieces 22, which align with multiple other magnets and/or pieces of ferromagnetic material in the other one of the right and left earpieces 22 and 24. In some embodiments, power transfer elements of the power transfer devices 70 and 72 are biased by a bias structure, such as a spring or resilient material, and the magnetic coupling of the coupler 74, at least partially, overcomes this bias to press the power transfer elements together to transfer power. In some embodiments, the coupler 74 is similar to the magnetic connector disclosed in U.S. Pat. No. 7,311,526.

In embodiments, the coupler 74 includes a first portion, such as a male connector, on one of the right and left earpieces 22 and 24 and a second portion, such as a female connector, on the other one of the right and left earpieces 22 and 24. The first and second portions can be press fit, snap fit, clipped, or otherwise engaged to hold the first and second power transfer devices 70 and 72 next to each other in the power transfer configuration. In some embodiments, the first and second portions of the coupler are hook and loop structures as in Velcro.

Figure 5:
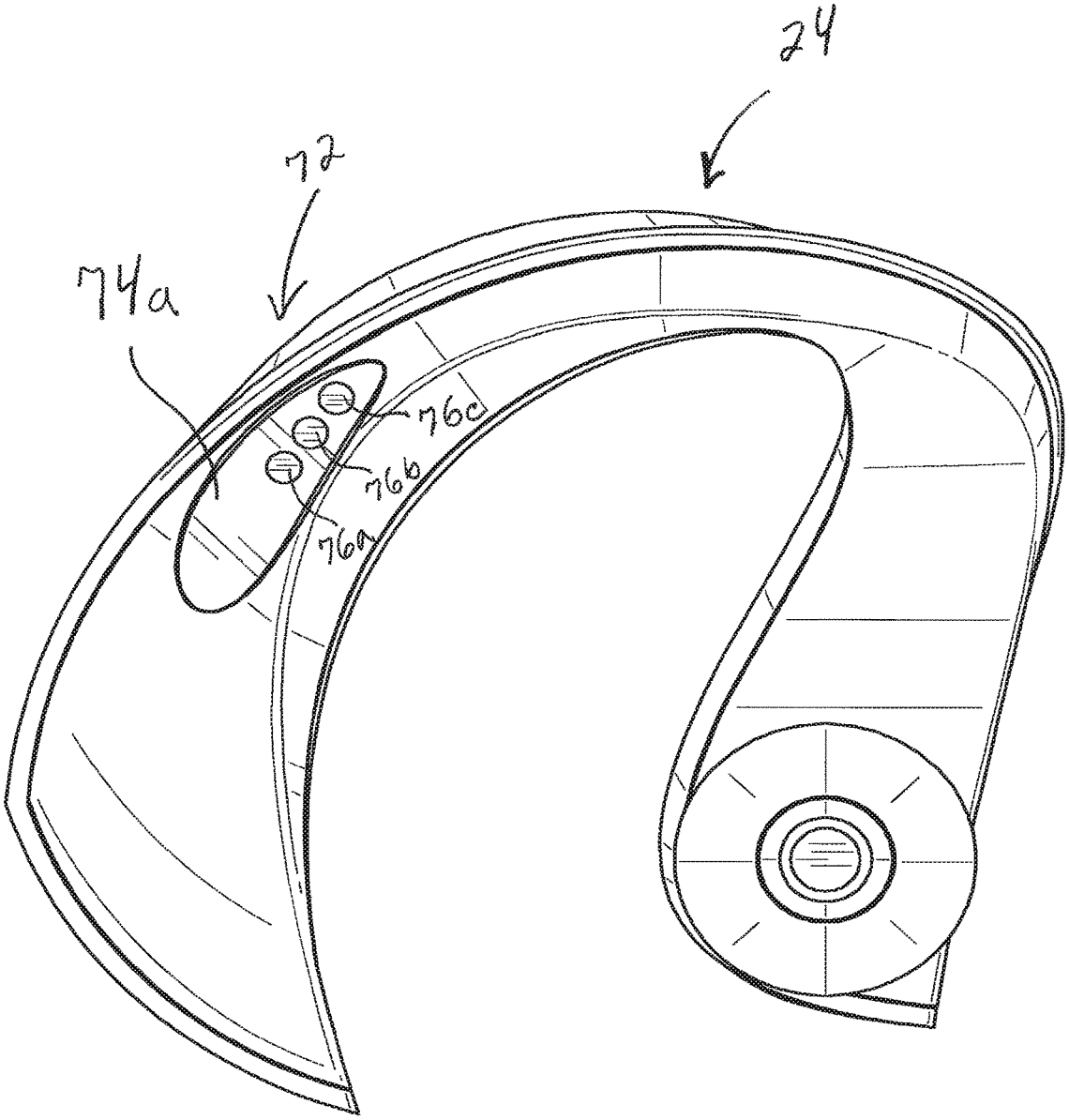
FIG. 5 is a diagram illustrating another side view of the left earpiece of the headphone system of FIG. 1, according to some embodiments described in the disclosure.

FIG. 5 is a diagram illustrating a side view of the left earpiece 24, according to some embodiments described in the disclosure. The left earpiece 24 includes the second power transfer device 72 and a first portion 74*a* of the coupler 74. The right earpiece 22 (not shown in FIG. 5) includes the first power transfer device 70 and a second portion of the coupler 74. In the power transfer configuration, the first power transfer device 70 mates with the second power transfer device 72 and the first portion 74*a* of the coupler 74 mates with the second portion of the coupler 74. In some embodiments, the layout of the right earpiece 22 mirrors the left earpiece 24. In other embodiments, the coupler 74 includes multiple portions, such as first portion 74*a*, in multiple locations in the left earpiece 24, which align with multiple other portions of the coupler 74 in the right earpiece 22.

The second power transfer device 72 includes three power transfer elements 76*a*-76*c*. In other embodiments, the second power transfer device 72 includes any suitable number of power transfer elements, such as less than or more than three elements.

In some embodiments, the power transfer elements 76*a*-76*c* include contacts that touch corresponding elements in the first power transfer device 70 to transfer power between the right and left earpieces 22 and 24. In some embodiments, the power transfer elements 76*a*-76*c* include electrical contacts that are press fit together with corresponding elements in the first power transfer device 70 to transfer power between the right and left earpieces 22 and 24. In some embodiments, the power transfer elements 76*a*-76*c* include inductive elements that are held close enough to corresponding elements in the first power transfer device 70 to accomplish inductive coupling and transfer power between the right and left earpieces 22 and 24. In some embodiments, the power transfer elements 76*a*-76*c* include capacitive elements that are held close enough to corresponding elements in the first power transfer device 70 to accomplish capacitive coupling and transfer power between the right and left earpieces 22 and 24. In some embodiments, each of the power transfer elements 76*a*-76*c* includes a conductive pin. In some embodiments, each of the power transfer elements 76*a*-76*c* includes a conductive pin having a convex/concave end that mates with a concave/convex end of a conductive pin in the first power transfer device 70.

In some embodiments, the second power transfer device 72 includes a bias structure to urge the power transfer elements 76*a*-76*c* outward from the left earpiece 24. In some embodiments, the bias structure includes a resilient piece of material, a spring, or a rib made of a resilient material into a leaf spring that biases the power transfer elements 76*a*-76*c* outward from the left earpiece 24.

In the embodiment illustrated in FIG. 5, the first portion 74*a* of the coupler 74 includes at least one magnet. In some embodiments, the first portion 74*a* of the coupler 74 is a natural magnet. In other embodiments, the first portion 74*a* of the coupler 74 can be as described in the description of FIG. 4. In other embodiments, the first portion 74*a* includes multiple magnets that align with multiple other magnets and/or pieces of ferromagnetic material in the right earpiece 22.

In the power transfer configuration, the power transfer elements 76*a*-76*c* of the second power transfer device 72 align with the power transfer elements of the first power transfer device 70 and the first portion 74*a* of the coupler 74 aligns with the second portion of the coupler 74 on the right earpiece 22. The aligned portions of the coupler 74 hold the power transfer elements 76*a*-76*c* of the second power transfer device 72 close enough to or in contact with the power transfer elements of the first power transfer device 70 to transfer power. In some embodiments, the power transfer elements of the first and second power transfer devices 70 and 72 are biased by a bias structure and the coupling of the coupler 74, at least partially, overcomes this bias to press the power transfer elements next to each other or together to transfer power.

Figure 6:
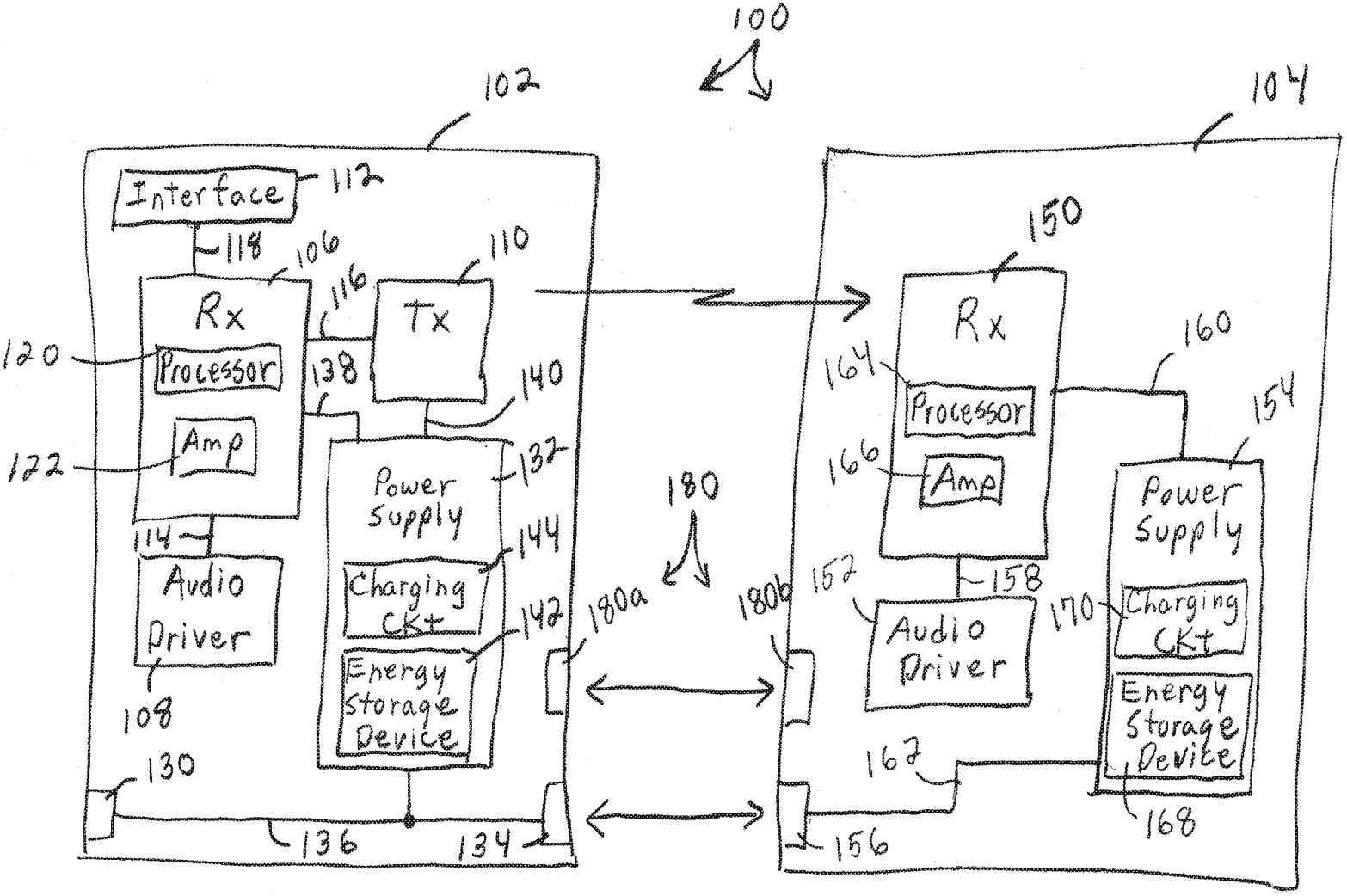
FIG. 6 is a block diagram illustrating a headphone system that includes a first earpiece and a second earpiece, according to some embodiments described in the disclosure.

FIG. 6 is a block diagram illustrating a headphone system 100 that includes a first earpiece 102 and a second earpiece 104, according to some embodiments described in the disclosure. The first earpiece 102 is either the right or the left earpiece of the headphone system 100 and the second earpiece 104 is the other earpiece of the right and left earpieces of the headphone system 100. In some embodiments, the headphone system 100 is similar to the headphone system 20 of FIG. 1, where the first earpiece 102 is similar to the right earpiece 22 and the second earpiece 104 is similar to the left earpiece 24. In other embodiments, components and functions of the first earpiece 102 can be switched to being in the second earpiece 104 and/or components and functions of the second earpiece 104 can be switched to being in the first earpiece 102.

In regard to FIG. 6, each of the first and second earpieces 102 and 104 includes certain components and performs certain functions of the headphone system 100. This is one example distribution of components and functions in the first and second earpieces 102 and 104, which is not intended to limit a component or a function to one of the first and second earpieces 102 and 104. Instead, in other examples, one or more of the components and functions described as being in the first earpiece 102 can be in the second earpiece 104 and/or one or more of the components and functions described as being in the second earpiece 104 can be in the first earpiece 102. For example, all of the components and functions of the first earpiece 102 can be in the second earpiece 104 and all of the components and functions of the second earpiece 104 can be in the first earpiece 102.

The first earpiece 102 includes a first receiver 106, a first audio driver 108, a transmitter 110, and a user interface 112. The first receiver 106 is electrically coupled to the first audio driver 108 via conductive path 114 and to the transmitter 110 via conductive path 116. The user interface 112 is electrically coupled to the first receiver 106 via conductive path 118. In some embodiments, the first receiver 106 is similar to the first receiver 36, the first audio driver 108 is similar to the audio driver 40, and the transmitter 110 is similar to the transmitter 42.

The first receiver 106 includes a first processor 120 and a first amplifier 122. The first processor 120 includes a master device address, such as a first MAC address, of the first earpiece 102 that is shared with external audio sources, such as the external audio source 26 (shown in FIG. 1). The master device address can be shared by transmitting the master device address via the transmitter 110. The first processor 120 also includes a slave device address, such as a second MAC address, of the second earpiece 104, which is not shared with the external audio sources, but kept hidden from the external audio sources. Using the master device address, the first earpiece 102 establishes a first communications link, such as a first Bluetooth link, between the first earpiece 102 and an external audio source. Using the slave device address, the first earpiece 102 establishes a second communications link, such as a second Bluetooth link, between the first earpiece 102 and the second earpiece 104. After the first communications link has been established, the first receiver 106 receives a first wireless signal having audio content from the external audio source. In some embodiments, the first processor 120 is similar to the first processor 38. In other embodiments, the master/slave roles are reversed, such that the second earpiece 104 is the master and includes the master device address, such as the first MAC address, that is shared with (transmitted to) the external audio source, and the first earpiece 102 is the slave that includes the slave device address, such as the second MAC address, that is known by the second earpiece 104, but unknown and not shared with (hidden from) the external audio source. In these embodiments, the second earpiece 104 includes a transmitter and, in at least some of these embodiments, the first earpiece 102 does not include a transmitter.

The first processor 120 is coupled to the first receiver 106 and receives the first wireless signal via the first receiver 106. The first processor 120 processes the first wireless signal and provides a first audio signal having at least a portion of the audio content, e.g., the right audio channel of a stereo signal, from the first wireless signal. In some embodiments, the first processor 120 includes memory and executes computer executable instructions stored in the memory to provide functions of the first earpiece 102, such as processing the first wireless signal received by the first receiver 106. In some embodiments, the first processor 120 is one of a micro-processor and a micro-controller. In some embodiments, the first processor 120 includes digital logic circuitry for providing functions of the first earpiece 102, such as processing the first wireless signal and providing the first audio signal. In some embodiments, the first processor 120 is an application specific integrated circuit (ASIC) that provides functions of the first earpiece 102.

The first amplifier 122 is coupled to the first processor 120 and receives the first audio signal from the first processor 120. The first amplifier 122 amplifies the first audio signal to drive the first audio driver 108 and reproduce at least a portion of the audio content for the user. In some embodiments, the first audio driver 108 includes multiple audio drivers that are driven by the first audio signal.

The volume of the audio content reproduced by the first and second earpieces 102 and 104 is adjusted using the user interface 112. In addition, the user interface 112 is used to switch the headphone system 100, including the first earpiece 102 and the second earpiece 104, into an on state and into an off state or standby mode. Also, the user interface 112 can be used for other user-controlled functions. In some embodiments, the user interface 112 includes a push activated button for switching the headphone system 100 into the on state and the off state or standby mode. In some embodiments, the user interface 112 includes a capacitive touch switch for tapping to switch the headphone system 100 into the on state and the off state or standby mode. In some embodiments, the user interface 112 includes a swipe mechanism for swiping up and down on the user interface 112 to adjust the volume of the audio content reproduced in the first earpiece 102 and the second earpiece 104.

The transmitter 110 receives a second wireless signal having at least a portion of the audio content in the first wireless signal from the first receiver 106, e.g., the left audio channel of a stereo signal, and transmits the second wireless signal to the second earpiece 104. In some embodiments, the first wireless signal is passed through from the first receiver 106 to the transmitter, such that the second wireless signal is similar to the first wireless signal. In some embodiments, the first processor 120 processes the first wireless signal to provide the second wireless signal, such that the second wireless signal includes all or a portion of the audio content of the first wireless signal.

The first earpiece 102 also includes a power source connector 130, a first power supply 132, and a first power transfer device 134. The power source connector 130 is electrically coupled to the first power supply 132 and to the first power transfer device 134 via conductive path 136. The first power supply 132 is electrically coupled to the first receiver 106 via conductive path 138 and to the transmitter 110 via conductive path 140. The first power supply 132 provides power to the first receiver 106 and to the transmitter 110 via conductive paths 138 and 140. In some embodiments, the power source connector 130 is similar to the power source connector 62 (shown in FIG. 4) and the first power transfer device 134 is similar to the first power transfer device 70.

The power source connector 130 is configured to be removably connected, i.e., connected to and removed from, an external power source, such as the external power source 60. The power source connector 130 is connected to the external power source to receive power from the external power source and charge the first and second earpieces 102 and 104, where the first earpiece 102 is coupled to the second earpiece 104 to charge the second earpiece 104. The first power supply 132 and the first power transfer device 134 are coupled to the power source connector 130 to receive power from the power source connector 130. In some embodiments, the power source connector 130 includes contacts that touch corresponding contacts connected to the external power source to transfer power. In some embodiments, the power source connector 130 includes electrical contacts that are press fit together with corresponding electrical contacts connected to the external power source to transfer power. In some embodiments, the power source connector 130 includes one or more inductive elements that interact with one or more inductive elements connected to the external power source to accomplish inductive coupling and transfer power. In some embodiments, the power source connector 130 includes one or more capacitive elements that interact with one or more capacitive elements connected to the external power source to accomplish capacitive coupling to transfer power. In some embodiments, the power source connector 130 includes a connector such as a universal serial bus (USB) connector or a micro-USB connector. In some embodiments, the power source connector 130 includes another suitable type of connector, such as the connector disclosed in U.S. Pat. No. 7,311,526.

In other embodiments, the second earpiece 104 is electrically coupled to the external power source and the first earpiece 102 receives power through the second earpiece 104, such that the components described above as being in the first earpiece 102, including the power source connector 130, are in the second earpiece 104 and the components described below as being in the second earpiece 104 are in the first earpiece 102.

The first power supply 132 includes a first energy storage device 142 and, optionally, a charging circuit 144. The first power supply 132 receives power from the power supply connector 130 and charges the first energy storage device 142. In some embodiments, the first power supply 132 receives power from the power supply connector 130 and the first energy storage device 142 is charged directly from the power supply connector 130. In some embodiments, the first power supply 132 includes the charging circuit 144 and the charging circuit 144 receives power from the power supply connector 130 and charges the first energy storage device 142. In some embodiments, the charging circuit 144 charges the first energy storage device 142 and provides power for charging the second earpiece 104. In some embodiments, the charging circuit 144 includes a voltage regulator.

The first energy storage device 142 stores the power or charge to power the first earpiece 102. In some embodiments, the first energy storage device 142 includes a rechargeable battery. In some embodiments, the first energy storage device 142 includes a capacitive storage device, such as a capacitor. In some embodiments, the first energy storage device 142 is similar to the first energy storage device 64 (shown in FIG. 4).

The first power transfer device 134 is coupled to the power source connector 130 to receive power and transfer at least some of the power to the second earpiece 104. In some embodiments, the first power transfer device 134 receives power directly from the power supply connector 130. In some embodiments, the first power transfer device 134 receives power from the optional charging circuit 144.

The second earpiece 104 includes a second receiver 150, a second audio driver 152, a second power supply 154, and a second power transfer device 156. The second receiver 150 is electrically coupled to the second audio driver 152 via conductive path 158 and to the second power supply 154 via conductive path 160. The second power transfer device 156 is electrically coupled to the second power supply 154 via conductive path 162. The second power supply 154 provides power to the second receiver 150 via the conductive path 160. In some embodiments, the second receiver 150 is similar to the second receiver 44 (shown in FIG. 1) and the second audio driver 152 is similar to the audio driver 48. In some embodiments, the second power transfer device 156 is similar to the second power transfer device 72 (shown in FIG. 4).

The second receiver 150 includes a second processor 164 and a second amplifier 166. The second processor 164 includes the slave device address, such as the second MAC address, of the second earpiece 104. This slave device address is known by the first earpiece 102 and a communications link, such as a Bluetooth link, is established between the first earpiece 102 and the second earpiece 104. With this communications link established, the second receiver 150 receives the second wireless signal having at least a portion of the audio content from the first wireless signal and transmitted via the transmitter 110. In some embodiments, the second processor 164 is similar to the second processor 46 (shown in FIG. 1).

The second processor 164 is coupled to the second receiver 150 and receives the second wireless signal via the second receiver 150. The second processor 164 processes the second wireless signal and provides a second audio signal having at least a portion of the audio content from the second wireless signal, e.g., the left audio channel of a stereo signal. In some embodiments, the second processor 164 includes memory and executes computer executable instructions stored in the memory to provide functions of the second earpiece 104, such as processing the second wireless signal received by the second receiver 150. In some embodiments, the second processor 164 is one of a micro-processor and a micro-controller. In some embodiments, the second processor 164 includes digital logic circuitry for providing functions of the second earpiece 104, such as processing the second wireless signal and providing the second audio signal. In some embodiments, the second processor 164 is an ASIC that provides functions of the second earpiece 104.

The second amplifier 166 is coupled to the second processor 164 and receives the second audio signal from the second processor 164. The second amplifier 166 amplifies the second audio signal to drive the second audio driver 152 and reproduce at least a portion of the audio content for the user. In some embodiments, the second audio driver 152 includes multiple audio drivers that are driven by the second audio signal.

The volume of the audio content reproduced by the second earpiece 104 can be adjusted using the user interface 112. Also, the second earpiece 104 can be switched to an on state and an off state or standby mode using the user interface 112. In some embodiments, the second wireless signal includes volume information that the second processor 164 recovers from the second wireless signal and uses to set the volume of the second audio drivers 152. In some embodiments, the second earpiece 104 can be switched to an on state and an off state or standby mode via the user interface 112 and information in the second wireless signal or another wireless signal.

The second power supply 154 includes a second energy storage device 168 and, optionally, a second charging circuit 170. The second power supply 154 receives power from the second power transfer device 156 and charges the second energy storage device 168. In some embodiments, the second power supply 154 receives power from the second power transfer device 156 and the second energy storage device 168 is charged directly from the second power transfer device 156. In some embodiments, the power supply 154 includes the second charging circuit 170 and the second charging circuit 170 receives power from the second power transfer device 156 and charges the second energy storage device 168. In some embodiments, the second charging circuit 170 includes a voltage regulator.

The second energy storage device 168 stores the power or charge to power the second earpiece 104. In some embodiments, the second energy storage device 168 includes a rechargeable battery. In some embodiments, the second energy storage device 168 includes a capacitive storage device, such as a capacitor. In some embodiments, the second energy storage device 168 is similar to the second energy storage device 66 (shown in FIG. 4).

In the power transfer configuration, the first power transfer device 134 is coupled to the second power transfer device 156 to transfer power to the second earpiece 104. In some embodiments, the first power transfer device 134 receives power directly from the power supply connector 130 and transfers the power to the second power transfer device 156 and the second power transfer device 156 transfers the power directly to the second energy storage device 168. In some embodiments, the first power transfer device 134 receives power directly from the power supply connector 130 and transfers the power to the second power transfer device 156 and the second power transfer device 156 transfers the power to the second charging circuit 170, which charges the second energy storage device 168. In some embodiments, the first power transfer device 134 receives power from the optional charging circuit 144 and transfers the power to the second power transfer device 156 and the second power transfer device 156 transfers the power directly to the second energy storage device 168. In some embodiments, the first power transfer device 134 receives power from the optional charging circuit 144 and transfers the power to the second power transfer device 156 and the second power transfer device 156 transfers the power to the second charging circuit 170, which charges the second energy storage device 168.

The first and second power transfer devices 134 and 156 transfer power between the first and second earpieces 102 and 104. In some embodiments, the first and second power transfer devices 134 and 156 include contacts that touch to transfer power between the first and second earpieces 102 and 104. In some embodiments, the first and second power transfer devices 134 and 156 include electrical contacts that are press fit together to transfer power between the first and second earpieces 102 and 104. In some embodiments, the first and second power transfer devices 134 and 156 include inductive elements that are held close enough together to accomplish inductive coupling to transfer power between the first and second earpieces 102 and 104. In some embodiments, the first and second power transfer devices 134 and 156 include capacitive elements that are held close enough together to accomplish capacitive coupling to transfer power between the first and second earpieces 102 and 104.

The first earpiece 102 and the second earpiece 104 include a coupler 180 that holds the first and second earpieces 102 and 104 together in the power transfer configuration. The coupler 180 includes a first coupler portion 180*a* in the first earpiece 102 and a second coupler portion 180*b* in the second earpiece 104. In some embodiments, the coupler 180, including the first and second coupler portions 180*a* and 180*b*, is similar to the coupler 74 (shown in FIGS. 4 and 5).

To transfer power, the first and second power transfer devices 134 and 156 are held next to each other in the power transfer configuration. In some embodiments, the first and second power transfer devices 134 and 156 are held next to each other to touch in the power transfer configuration. In some embodiments, the first and second power transfer devices 134 and 156 are held next to each other to engage each other in the power transfer configuration. In some embodiments, the first and second power transfer devices 134 and 156 are held next to each other to be close enough to each other to transfer power in the power transfer configuration.

In the power transfer configuration, the first and second power transfer devices 134 and 156 are held together by the coupler 180 that holds the first and second earpieces 102 and 104 together. In some embodiments, the coupler 180 is situated next to the first and second power transfer devices 134 and 156. In some embodiments, the coupler 180 is part of the first and second power transfer devices 134 and 156, such as with electrical contacts that are press fit together. In other embodiments, the coupler 180 or the first and second coupler portions 180*a* and 180*b* can be situated at any suitable position in the first and second earpieces 102 and 104.

In embodiments, the coupler 180 includes at least one magnet in one of the first and second earpieces 102 and 104 that aligns with at least one other magnet or ferromagnetic material in the other one of the first and second earpieces 102 and 104, in the power transfer configuration. The coupler 180 provides magnetic coupling that holds electrical contacts on each of the first and second earpieces 102 and 104 together to transfer power through the electrical contacts. In some embodiments, the coupler 180 includes multiple magnets in multiple locations in one of the first and second earpieces 102 and 104, which align with multiple other magnets and/or pieces of ferromagnetic material in the other one of the first and second earpieces 102 and 104. In some embodiments, the electrical contacts are biased, such as by a spring or resilient material, and the magnetic coupling of the coupler 180, at least partially, overcomes the bias to press the electrical contacts together to transfer power. In some embodiments, the coupler 180 is similar to the connector disclosed in U.S. Pat. No. 7,311,526.

In some embodiments, the coupler 180 includes a first structure, such as a male connector on one of the first and second earpieces 102 and 104 and a second structure, such as a female connector, on the other one of the first and second earpieces 102 and 104. These first and second structures can be press fit together or otherwise engaged to hold the first and second power transfer devices 134 and 156 next to each other in the power transfer configuration.

In operation, for listening to audio content, the first and second earpieces 102 and 104 are separated from the joined charging configuration and inserted into the ears of the user. The user interface 112 is pushed to switch on the first and second earpieces 102 and 104 and the first and second earpieces 102 and 104 establish a communications link between them using the slave device address. If the user switches on an external audio source, such as a mobile telephone, the first earpiece 102 can establish a communications link with the external audio source via the master device address. In some embodiments, a wireless signal can be sent from the first earpiece 102 to the second earpiece 104 to switch on or wake up the second earpiece 104.

Next, the external audio source provides a first wireless signal having audio content, which is received by the first receiver 106 and processed by the first processor 120 to provide the first audio signal that drives the first audio driver 108. Also, the transmitter 110 transmits a second wireless signal having at least a portion of the audio content from the first wireless signal. The second earpiece 104, which is in communication with the first earpiece 102, receives the second wireless signal via the second receiver 150 and the second processor 164 processes the second wireless signal to provide the second audio signal that drives the second audio driver 152. In some embodiments, the first processor 120 introduces a synchronizing time delay in providing the first audio signal and/or the second wireless signal to synchronize the first audio signal with the second audio signal. In some embodiments, the second processor 164 introduces a synchronizing time delay in providing the second audio signal to synchronize the first audio signal with the second audio signal. In some embodiments, at least one of the first and second wireless signals is an RF signal. In some embodiments, at least one of the first and second wireless signals is a Bluetooth signal.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

The invention claimed is:

1. A headphone system, comprising:

a first earpiece including:

a first ear hook;

a first ear tip;

a first audio driver on the first ear tip;

a first receiver;

a first processor;

a transmitter;

a power source connector configured to be removably and electrically coupled to an external power source via a conductive path;

a first energy storage device coupled to the power source connector and configured to receive power from the external power source via the power source connector; and a first power transfer device electrically coupled to the first power source connector and configured to transfer power away from the first earpiece when in a power transfer configuration;

wherein at least one of the first receiver, first processor, and transmitter is on the first ear hook; and a second earpiece including:

a second ear hook;

a second ear tip;

a second audio driver on the second ear tip;

a second receiver;

a second processor;

a second power transfer device configured to be removably and electrically coupled to the first power transfer device such that the second power transfer device is electrically coupled to the first power transfer device when in the power transfer configuration; and a second energy storage device electrically coupled to the second power transfer device to receive power from the first earpiece via the first power transfer device and the second power transfer device when in the power transfer configuration;

wherein at least one of the second receiver and second processor is on the second ear hook.

2. The headphone system of claim 1, wherein at least one of the first energy storage device and the first power transfer device is on the first ear hook.

3. The headphone system of claim 1, wherein the first energy storage device is electrically connected to at least one of the first audio driver, the first receiver, the first processor, and the transmitter.

4. The headphone system of claim 1, wherein at least one of the second energy storage device and the second power transfer device is on the second ear hook.

5. The headphone system of claim 1, wherein the second energy storage device is electrically connected to at least one of the second audio driver, the second receiver, and the second processor.

6. The headphone system of claim 1, wherein the power source connector includes one or more inductive elements for inductive coupling and power transfer with the external power source.

7. The headphone system of claim 1, wherein the power source connector includes one or more capacitive elements for capacitive coupling and power transfer with the external power source.

8. The headphone system of claim 1, wherein the power source connector includes electrical contacts for power transfer with the external power source.

9. The headphone system of claim 1, wherein the first and second power transfer devices include inductive elements for inductive coupling to transfer power between the first and second earpieces.

10. The headphone system of claim 1, wherein the first and second power transfer devices include capacitive elements for capacitive coupling to transfer power between the first and second earpieces.

11. The headphone system of claim 1, wherein the first earpiece includes a first magnetic coupler and the second earpiece includes a second magnetic coupler configured to be magnetically coupled to the first magnetic coupler to help keep the second power transfer device coupled to the first power transfer device in the power transfer configuration.

* * * * *